United States Patent [19]

Eigenmann

[11] 4,082,587

[45] Apr. 4, 1978

[54] METHOD AND DEVICES FOR ROAD SURFACE MARKING

[76] Inventor: Ludwig Eigenmann, Vacallo, Ticino, Switzerland

[21] Appl. No.: 652,523

[22] Filed: Jan. 26, 1976

[30] Foreign Application Priority Data

Jan. 24, 1975 Italy ..... 19573 A/75

[51] Int. Cl.[2] ..... E01C 23/16

[52] U.S. Cl. ..... 156/71; 156/309; 118/202; 401/1; 401/136; 404/79; 404/94; 427/138

[58] Field of Search ..... 156/71, 309; 404/72, 404/79, 94; 401/1, 136, 83, 79; 427/136–138; 118/202

[56] References Cited

U.S. PATENT DOCUMENTS

| | | | |
|---|---|---|---|
| 1,726,832 | 9/1929 | Hollingshead | 401/2 |
| 2,043,188 | 6/1936 | Walten | 401/2 |
| 2,089,911 | 8/1937 | Replogle | 401/1 |
| 3,279,336 | 10/1966 | Eaton et al. | 401/1 |
| 3,352,279 | 11/1967 | Lockwood | 118/202 |
| 3,376,850 | 4/1968 | Pierce | 118/202 |
| 3,682,054 | 8/1972 | MacPhail et al. | 404/94 |
| 3,844,668 | 10/1974 | Winters et al. | 404/72 |
| 3,844,669 | 10/1974 | Eigenmann | 404/94 |
| 3,902,939 | 9/1975 | Eigenmann | 404/94 |

*Primary Examiner*—Edward G. Whitby
*Attorney, Agent, or Firm*—Michael J. Striker

[57] ABSTRACT

There is described a method for road surface marking with tape material, including the steps of forming an essentially bituminous primer layer on such surface and then pressingly laying a prefabricated tape material on said primer layer, such layer being formed with an essentially thermoplastic composition containing at least 60% by weight of solid thermoplastic substances fluidified for intimately contacting the road surface. The layer is capable of quickly solidifying to a viscosity of at least $10^3 - 10^4$ cP for receiving the tape material and then up to at least $10^5$ cP within 30 seconds to provide a bond between the tape and said surface capable of resisting horizontal stresses of at least 1.5 Kg/cm². Thereafter, the later further hardens at ambient temperature resist to a stress of at least 3 Kg/cm². There are also described devices for applying such composition and tape and for melting the said solid thermoplastic substances.

9 Claims, 5 Drawing Figures

METHOD AND DEVICES FOR ROAD SURFACE MARKING

BACKGROUND OF THE INVENTION

1. Field of the Invention

This invention is generally concerned with the art of road and highway marking with strip or tape material, namely for providing a road or highway with centre-lines or with traffic lane-dividing lines or the like, prevailingly but not exclusively arranged lengthwise of the road.

More particularly, the present invention is concerned with the art of providing traffic signs of the above type, consisting of prefabricated tape material laid on the road surface upon a relatively thin underlayer generally comprising bitumen or asphalt or the like capable of thoroughly filling any road surface porosity, holes and hollows thus providing a tape material receiving, impervious, flat and planar surface which achieves a firm and permanent bond of the tape material to the road pavement.

Such underlayer is generally and usually indicated, in the art of road surface marking as above, by the word "primer layer" and therefore said expression will be made use of as this description proceeds and in the appended claims. This invention is principally concerned with the art of compounding, forming, applying on the road pavement and taking advantage of a new and advantageous primer layer as hereinbelow set forth.

2. Description of the Prior Art

The art of road surface marking with tape material is well worked one and a wide technical and patent literature thereabout exists. With relation to this art reference is herein made to the U.S. Pat. Nos. 3,399,607 and 3,587,415, of the present Applicant. As far as the machines and devices for providing a road pavement with such markings are concerned, reference is also made to the U.S. Pat. Nos. 3,007,838, 3,155,564, 3,235,436, 3,262,375 and 3,844,669, of the same Applicant.

It is also known that in relatively recent years the road marking tape materials have been substantially improved by making them "non skidding", that is adapted to provide a sure frictional adherence with the vehicles' tires, such a tape material being described, for example, in the applicant's U.S. Pat. No. 3,782,842. This provision, which is essential for traffic safety, has made it imperative that the tape material be most firmly secured to the road pavement to prevent detachment and stripping of the tape from said pavement, under the extremely severe inertial force exerted by fast and heavy vehicles such as in the event of emergency braking, accelerations and so on.

It is further known to those skilled in the art that the entire cycle of operations required for marking a road surface involves a considerable overall time. Such time will seriously disturb the availability of the highway, and the traffic must be kept far from the areas to be marked. The time involved in the process of complete setting of the primer layer, from the very time at which the primer layer composition is laid in contact with the road pavement to the very time at which the same composition has been hardened to form a consistent and load and stress resistant layer, is principally responsible for the evidently undesirable traffic disturbance.

It is therefore the principal object of the invention to provide a new and advantageous method for road surface marking, comprising the essential steps of forming a primer layer on said pavement and laying a prefabricated mark-forming tape material, the invention including a solution to the sharply antithetical problems of (i) shortening as much as possible such overall time and therefore decreasing the traffic disturbance and (ii) providing the most firm and permanent binding of the tape material to the road pavement by means of a completely set and properly hardened primer layer which is intimately secured to said pavement.

SUMMARY OF THE INVENTION

An essential basis of the invention consists in the analysis of the said overall time, as follows:

1st Period: from the very time at which the primer layer forming composition is caused to contact the roadway pavement surface to the time at which the laying down and pressing of the tape material on said layer have been completed.

Therefore this 1st Period comprises the steps of pouring or otherwise laying a substantially fluidified composition on the road pavement, causing the intimate penetration of said composition in the pores of such pavement, promoting a certain viscosity of the laid down composition to obtain a layer, doctoring said layer to provide the same with an upper smooth face, and laying and pressing the tape material on the thus formed primer layer face when said layer has attained a consistency sufficient to resist said laying and pressing. It is evident that such steps will occur, at any given location of the area to be marked, during the passage of the road-marking machine over said location.

2nd Period: from the end of said said 1st Period to the time at which the marked area can be safely reopened to traffic, the term "safely" meaning herein that the sign has become able to resist, without damage, the regular traffic, taking into consideration the type and density of the traffic and the specific roadway being marked, but the term safely allowing for the possibility that the freshly formed marking might be spoiled upon the occurrence of an exceptional that is a statistically rare stress (such as an emergency braking) applied to said marking, which latter individually forms a minor part of the entire road surface area open to traffic.

3rd Period: from the end of the 2nd Period to the time at which the primer layer has been completely set and the entire stratified marking structure has acquired its final and best status and ability to resist any stress which it has been designed to resist.

The above analysis has been conceived upon the premise that it is not worth keeping the traffic far from a freshly marked area for a time longer than that required for the marking to become "reasonably" resistant to the statistically most common traffic stresses. Other premises of the above analysis are:

(a) The primer layer composition should be nearly liquid and capable of properly "wetting" when contacted with the road pavement;

(b) the laying down and pressing of the tape material on the primer layer requires that the compound which forms such layer will have a viscosity of not less than $10^3$ cP (centipoises) and preferably of about $10^4$ cP;

(c) the opening of the marked area to traffic should occur when the primer layer is so hardened as to provide a resistance of at least 1.5 kg/cm$^2$ to frictional stresses horizontally applied to the tape surface. This resistance is generally provided when the average viscosity of the primer layer compound is in the range from $10^5$ to $10^6$ cP;

(d) the primer layer, when completely set, should provide a bond between the tape and the road pavement which such is as to raise the above resistance up to at least about 3 kg/cm$^2$.

A particular class of compounds adapted for forming the primer layer comprises compounds of essentially thermoplastic nature. The term "essentially thermoplastic nature" as used herein encompasses materials, compounds and compositions which harden when cooled and whose viscosity is essentially inversely proportional to the temperature. The method according to this invention contemplates the use of compounds of such nature and having generally a high content of bituminous components.

According to the invention, the method comprises forming of the road pavement by making use of an adhesive compound which is solid, that is has a very high viscosity of at least $10^5$ cP, at ambient temperature, which includes at least 60% by weight of thermoplastic components and organic substances, which fluidizes down to $10^3$ to $10^4$ cP at the temperature at which the compound is prepared for spreading the same on the roadway pavement, and which additionally comprises wetting cross-linkable agents.

The invention will now be described in detail with reference to the accompanying drawings.

DESCRIPTION OF THE PREFERRED EMBODIMENTS

Figure 1:
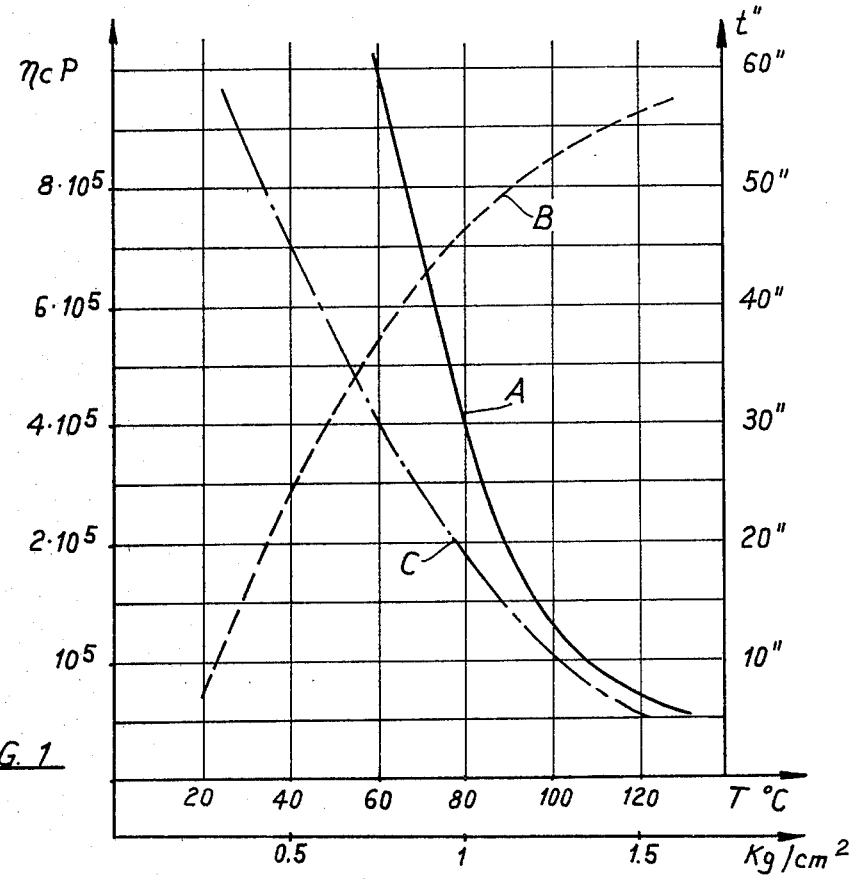
FIG. 1 is a graph representative of the viscosity versus the temperature of an essentially thermoplastic compound according to the invention.

Referring first to the graph of FIG. 1, the method comprises making use of a thermoplastic compound the viscosity $\eta_{cP}$ of which varies, with the temperature T° C, according to a curve of the type indicated at A. Below the abscissa along which the temperatures are indicated, the graph comprises another scale, wherein the resistances to horizontal stresses are indicated in kg/cm$^2$. Curve B is a plot of the viscosities $\eta_{cP}$ versus the resistances to horizontal stresses. The curve C, in dot-and-dash lines, refers to the scale of time $t''$, on the right side of the graph, and approximately indicates the time, in seconds, required to lower the temperature of a freshly laid primer layer to increasing its viscosity to the values indicated for the different temperatures on the abscissa, on a road pavement having a temperature of about 20° C.

Figure 2:
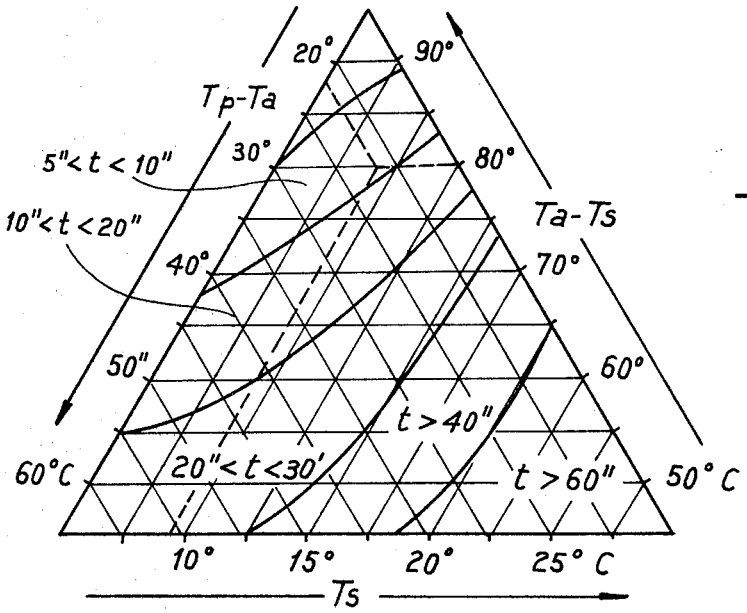
FIG. 2 is a ternary graph which indicates the times of closure to traffic of the area being marked.

From the graph of FIG. 1 there is seen that the minimum resistance compatible with re-opening of a freshly marked area to traffic can be attained within about 55 seconds. Such result can be attained provided that certain critical relationships, shown in the graph of FIG. 2, are satisfied. In said graph, $T_s$ indicates the road pavement temperature, $T_p$ the temperature of the primer composition at the time of its first contact with the pavement, and $T_a$ the temperature of the primer layer, in the freshly formed marking, compatible with re-opening of the marked area to traffic. The critical difference $T_a$ minus $T_s$ is indicated in the slanting scale at the right.

The area of the ternary graph is subdivided into subareas each identified by values and ranges of times t, in seconds, required for the necessary hardening of the layer.

Such graph is self-explanatory. It positively proves the importance of making use of a composition which (i) has a high solidification temperature (for having a high $T_a$) and (ii) exhibits a small temperature difference between the state in which the layer can be spread, doctored and coated by the tape material and the state in which its hardness is such as to prevent substantial internal flowing.

A few Examples of compounds adapted for providing satisfactory primer layers will now be described in parts by weight:

EXAMPLE 1

There is described a "monocomponent" composition, which does not require the use of "wetting" additives.

| | |
|---|---|
| Pitch (of the type commercially known as "Epoxy grade")and melting at 115° C | 20 |
| Styrene-butadiene resin or other synthetic rubber, such as for example "Pliolite S 6 F" (Goodyear) | 5 |
| Tar fractionated part for epoxy resin, such as "Epoxy tar, WHA 2" type | 5 |
| Coumarone resin (such as "Cumar P 25") | 10 |
| Phenolic colophony resin (such as "Vinsol" resin (Hercules)) | 60 |
| Oxidized bitumen | 100 |
| Bitumen 40/50 | 100 |

The above composition is advantageously spread upon a road pavement which has been preliminarily wetted by a spray of a two-component liquid composition, such as

| | | |
|---|---|---|
| "A" | Epoxy resin (such as "Araldite G 7 250") | 260 |
| | Epoxy tar | 100 |
| "B" | Catalyst for epoxy resin (such as "Ankamine XT") | 65 |
| | Epoxy tar | 115 |
| | Accelerator for epoxy resin (such as "D M P 30") | 20 |
| | Cresylic acid | 100 |

EXAMPLE 2

This Example concerns a meltable composition including wetting polyamidic components, and adapted to provide results as indicated by the viscosity curve of the graph of FIG. 1 in the time interval 10″ – 20″ of the ternary graph of FIG. 2.

As polyamide resins there are indicated, for example those manufactured and sold by Schering, as follows

| | |
|---|---|
| "Versamid 940" | 65 |
| "Versamid 100" | 5 |

The meltable or fusible composition comprises:

| | |
|---|---|
| Vinyl-ethylene acetate copolymer (such as "Elvax 240" - DuPont) | 20 |
| Colophony ester (such as "Foral 85" - Hercules) | 10 |

-continued

| | |
|---|---|
| Oxidized bitumen | 100 |
| Bitumen 40/50 | 100 |

EXAMPLE 3

This Example concerns a two-component primer layer composition, comprising prevailing thermoplastic components complemented by additives adapted to provide a relatively slow cross-linking associated with a satisfactorily rapid hardening of the thermoplastic part of the compound.

| | | |
|---|---|---|
| "A" | Pitch ("Epoxy grade") melting point 115° C | 20 |
| | Styrene-butadiene resin with high styrene content (such as "Pliolite S 6 F") | 5 |
| | Epoxy tar | 10 |
| | Oxidized bitumen | 20 |
| | Bitumen 120 | 20 |
| | Hydrocarbon resin (such as "Eskorez 1102") (Esso) | 10 |
| | Epoxy resin (such as "Epon 828")(Shell) | 15 |
| "B" | "Versamid 100" | 10 |
| | "Versamid 140" | 10 |
| | Oxidized bitumen | 30 |
| | Bitumen 40/50 | 40 |
| | Epoxy tar | 10 |

Figure 3:
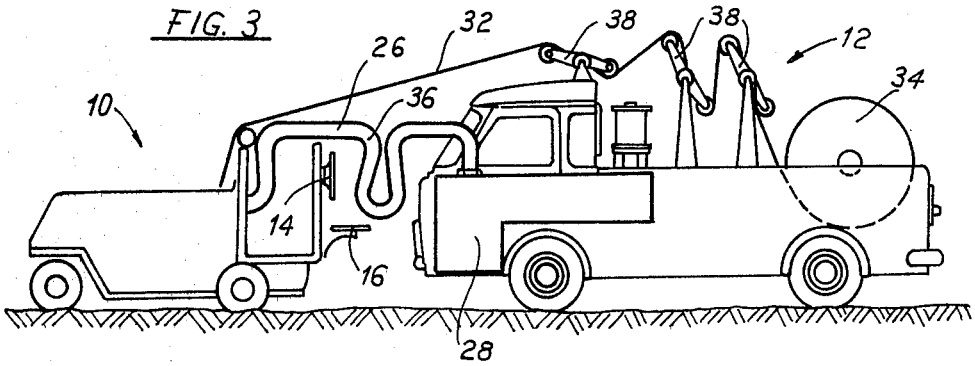
FIG. 3 is a diagrammatical side view of an apparatus adapted for carrying out the invention.
Figure 4:
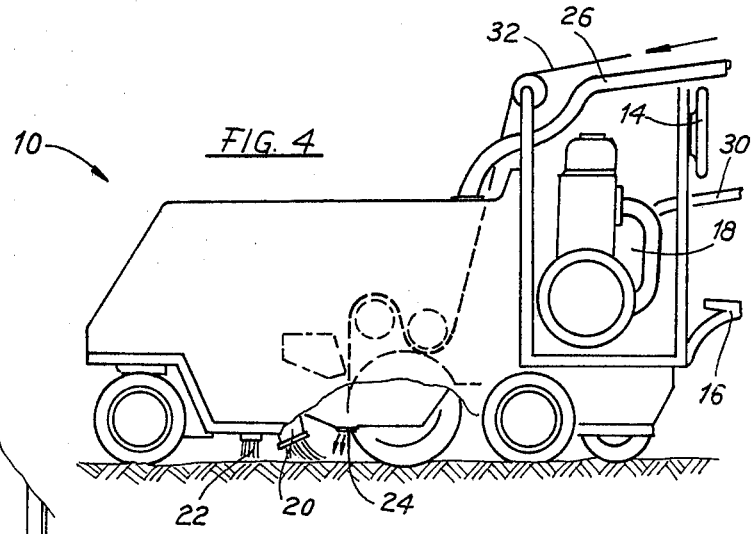
FIG. 4 diagrammatically illustrates certain details of said apparatus.

Compositions as above can advantageously be made use of for forming road surface markings by means of an apparatus as shown in FIGS. 3 and 4 and preferably consisting of a primer layer and marking tape material applying vehicle generally indicated at 10 and of a supply or service vehicle generally indicated at 12.

As shown in FIG. 4 the vehicle 10 includes steering means 14, a seat 16 for the operator, a motor 18, a pouring device 20 for pouring the molten thermoplastic composition, and spraying devices 22 and 24 located forward and rearward of means 20 for spraying the liquid wetting and thermosetting additives. The molten material is supplied to said device 20 through a pipe 26 by a melting unit 28, and further pipes 30 (FIG. 4) are provided for supplying the liquid additives. The marking tape material 32 is also supplied by the supply vehicle 12 and is unwound from a bobbin 34.

For taking into account the relative movements of the two vehicles, elbows 36 are provided along the said pipes, and oscillatory braces 38 are provided for guiding and supporting the tape 32.

Figure 5:
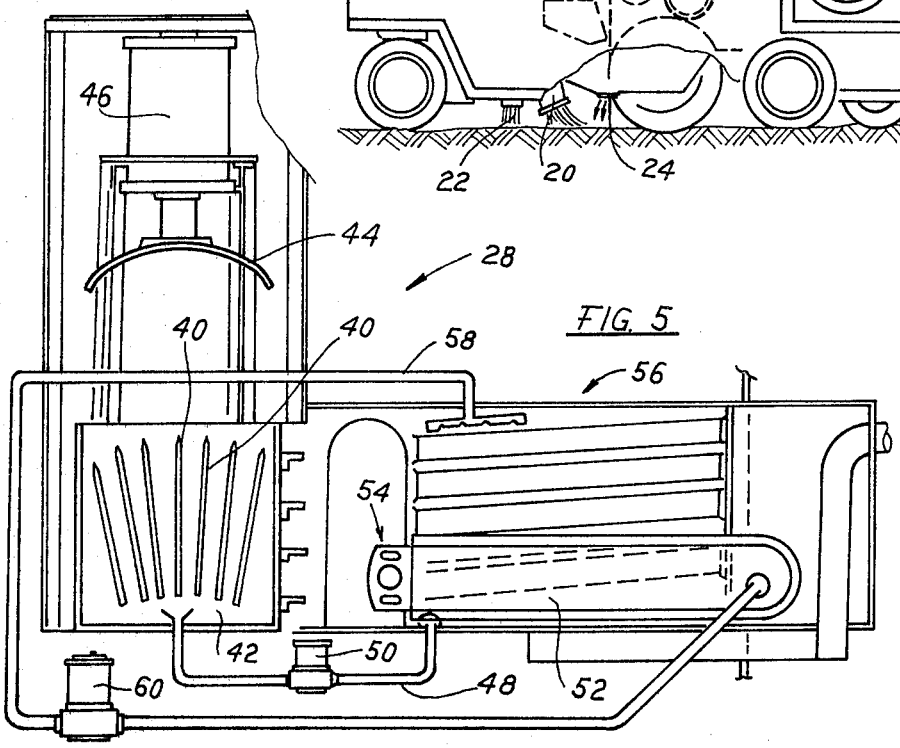
FIG. 5 is a somewhat simplified vertical sectional view of a device, comprised in said apparatus, for quickly melting substantial amounts of thermoplastic components.

The melting unit 28 preferably comprises, as shown in FIG. 5, a plurality of two-walled blades 40 each having an upwardly turned cutting wedge portion and enclosed in a container 42. Blocks of solid thermoplastic compound are located above said blades 40 and a pressing concave plate 44, preferably actuated by a ram 46 is actuated for urging said blocks against and between the blades, as such blocks have plasticized upon contact with the blade surfaces. Said blades are heated by circulating therein a heated diathermic oil, by means of ducts 48 and a pump 50. The oil is heated in a tubular boiler 52, the burner 54 of which is fed with liquid or gas fuel. The same burner heats also an enclosure 56 wherein the molten compound is collected and stored while being circulated through ducts 58 and a pump 60, ready for supply to the machine 10 for application to the road pavement.

I claim:

1. A method of forming a traffic - regulating indicium on a pavement, comprising forming a primer layer on said pavement by applying thereto a heated composition in flowable state which is of such a nature that the viscosity thereof increases as the temperature decreases from the temperature of application of said composition to said pavement, said composition having such a viscosity upon application thereof to said pavement that said composition intimately contacts said pavement, and said composition being capable of rapidly attaining a viscosity in the range of about $10^3$ to $10^4$ cP when said composition has a viscosity below said range upon being applied to said pavement, said composition further being capable of undergoing an increase in viscosity on said pavement from said range to a higher viscosity of at least $10^5$ cP within a period of about 30 seconds; and applying a marker tape to said primer layer when the viscosity thereof is substantially in said range to thereby preliminary bond said marker tape to said primer layer, said marker tape becoming more securely bonded to said primer layer as the viscosity of said primer layer increases from said range towards said higher viscosity.

2. The method of claim 1, said primer layer forming a bond with said tape at a viscosity above about $10^5$ cP which is capable of resisting a horozontally applied stress of 1.5 kg/cm$^2$; and wherein said composition is capable of further hardening to a condition such that the bond between said primer layer and said tape is able to withstand a horizontally applied stress of at least 3 kg/cm$^2$.

3. The method of claim 1, wherein said marker tape is pressed into said primer layer.

4. The method of claim 1, wherein said composition comprises a bituminous component.

5. The method of claim 1, wherein the viscosity of said composition is approximately inversely proportional to the temperature thereof.

6. The method of claim 1, wherein said composition has a high viscosity at ambient temperature and comprises at least 60 percent by weight of one or more thermoplastic substances having an average melting temperature such that the viscosity of said composition is approximately in said range at the temperature of application of said composition to said pavement.

7. The method of claim 6, wherein said composition further comprises a wetting agent.

8. The method of claim 7, wherein said wetting agent comprises a member of the group consisting of amidic, sulphonic, hydroxy, epoxy and isocyanic radicals.

9. The method of claim 6, wherein said composition further comprises one or more thermosetting resins in such a quantity as to impart to said primer layer a high resistance to stress at ambient summer temperatures.

* * * * *